US005483978A

United States Patent [19]

Doiron

[11] Patent Number: 5,483,978

[45] Date of Patent: Jan. 16, 1996

[54] LIGHTER WITH GUARD

[75] Inventor: Gerald J. Doiron, Athol, Mass.

[73] Assignee: Bic Corporation, Milford, Conn.

[21] Appl. No.: 97,685

[22] Filed: Jul. 28, 1993

[51] Int. Cl.[6] ..... F23D 11/36

[52] U.S. Cl. ..... 131/329; 431/267; 431/273; 431/274; 431/153

[58] Field of Search ..... 131/329; 431/129, 431/153, 133, 134, 135, 137, 139, 144, 146, 149, 276, 267, 270, 273, 274

[56] References Cited

U.S. PATENT DOCUMENTS

| | | | |
|---|---|---|---|
| D. 205,465 | 8/1966 | Breman | D48/27 |
| D. 211,822 | 7/1968 | Banninger | D48/27 |
| D. 212,382 | 10/1968 | van Poppel | D48/27 |
| D. 212,828 | 11/1968 | van Poppel | D48/27 |
| D. 216,328 | 12/1969 | Gujer | D48/27 |
| D. 217,017 | 3/1970 | Beijering | D48/27 |
| D. 229,712 | 12/1973 | Vogel | D48/27 R |
| D. 240,303 | 6/1976 | Neyret | D27/42 |
| D. 241,556 | 9/1976 | Matsuo | D27/42 |
| D. 247,051 | 1/1978 | Tricot | D27/42 |
| D. 272,564 | 2/1984 | Racek | D27/42 |
| 2,168,732 | 8/1939 | Dubsky | 67/7.1 |
| 2,498,377 | 2/1950 | Nissen | 431/137 X |
| 3,174,309 | 3/1965 | Kobayashi | 67/7.1 |
| 3,439,994 | 4/1969 | Cassan | 431/254 |
| 3,752,637 | 8/1973 | Norman | 431/274 |
| 3,756,766 | 9/1973 | Green | 431/254 |
| 3,884,616 | 5/1975 | Neyret | 431/276 X |
| 3,884,618 | 5/1975 | Neyret | 431/276 X |
| 3,895,905 | 7/1975 | Nissen | 431/254 |
| 3,938,943 | 2/1976 | Malamoud | 431/144 X |
| 3,994,666 | 11/1976 | Spinosa | 432/144 |
| 4,028,043 | 6/1977 | Neyret | 431/144 |
| 4,049,370 | 9/1977 | Neyret | 431/144 |
| 4,190,412 | 2/1980 | Nitta | 431/151 |
| 4,416,612 | 11/1983 | Tabeta | 431/131 |
| 4,846,667 | 7/1989 | Lin | 431/151 |
| 5,017,128 | 5/1991 | Hunter | 431/277 |
| 5,085,578 | 2/1992 | Hunter | 431/277 |

FOREIGN PATENT DOCUMENTS

| | | | |
|---|---|---|---|
| 637828 | 5/1928 | France | 431/129 |
| 936273 | 7/1948 | France | 431/139 |
| 0677021 | 3/1991 | Switzerland | 431/129 |

*Primary Examiner*—Jennifer Bahr
*Attorney, Agent, or Firm*—Pennie & Edmonds

[57] ABSTRACT

A disposable roll and press operated lighter including a shield shaped to the wheel and adapted to partly cover the wheel deterring a child from turning the wheel to an extent that ignites vapor from the lighter.

25 Claims, 4 Drawing Sheets

LIGHTER WITH GUARD

FIELD OF THE INVENTION

A lighter that is operated in the same manner as the prior art lighters using a wheel to produce a spark, but is difficult for a young child to light.

BACKGROUND OF THE INVENTION

Recently, attention has been directed toward preventing ready actuation of the lighters by persons normally not able to appreciate the potential danger of the flame. Such danger includes the potential to burn the individual directly or to burn surrounding areas or items. Individuals normally contemplated in these efforts are young children in the age category of five years or younger.

SUMMARY OF THE INVENTION

An object of the invention is to help prevent fires caused by young children playing with lighters.

Another object of the present invention is to provide a lighter having a guard that should provide a young child with sufficient deterrent features as to help prevent the child from readily producing a flame, or to deter the child from readily producing a flame at least for a time sufficient to permit the normally expected adult intervention.

PREFERRED EMBODIMENT OF THE INVENTION

Figure 1:
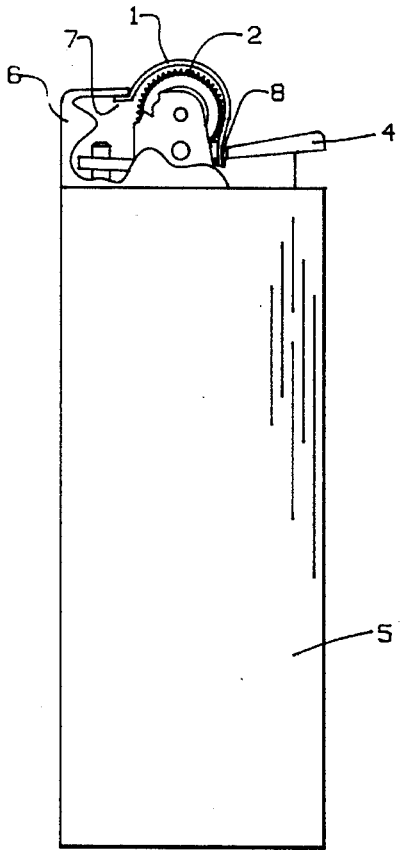
FIG. 1 is an elevational view of a lighter embodying the invention.

To ignite this lighter it takes a requisite amount of physical force to apply enough thumb pressure to depress the sparker wheel shield 1 as shown in FIGS. 1 through 8. As shown in the Figures, lighter 5 according to the invention generally includes a gas valve 12 cooperating with gas release lever 4 mounted on pivot 11, windbreaker 6 around gas valve 12, and sparker wheel 3 with knurled knobs 2 mounted on axle 10 on a fork-like structure at the top of the lighter.

Figure 2:
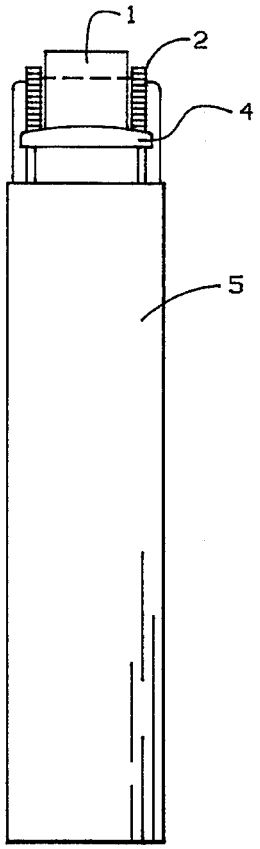
FIG. 2 is a side elevation view of FIG. 1.
Figure 3:
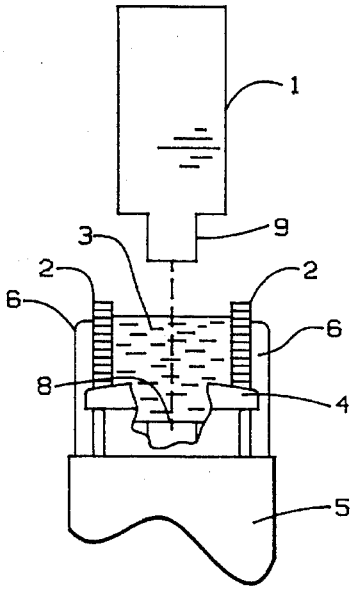
FIG. 3 is a combined and enlarged view of the invention.
Figure 4:
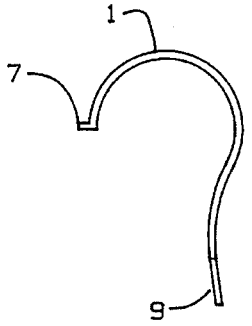
FIG. 4 is a view in side elevation of the invention per se.
Figure 5:
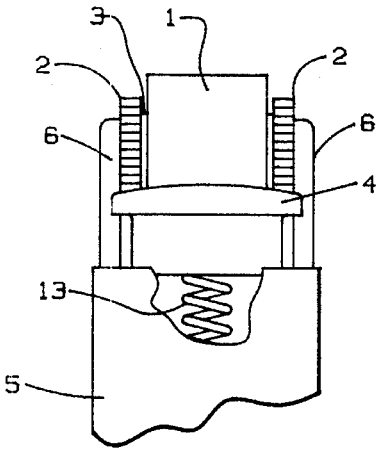
FIG. 5 illustrates the invention at rest.
Figure 6:
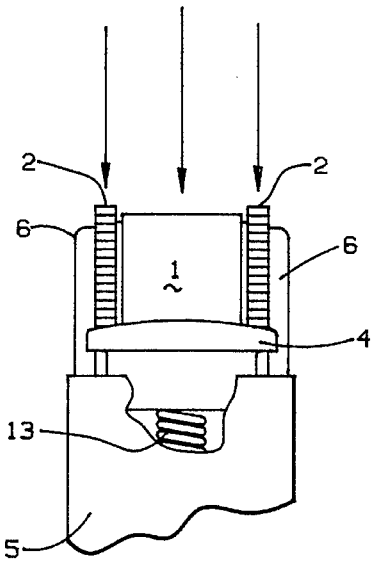
FIG. 6 is a view similar to FIG. 5 showing the invention in use.
Figure 7:
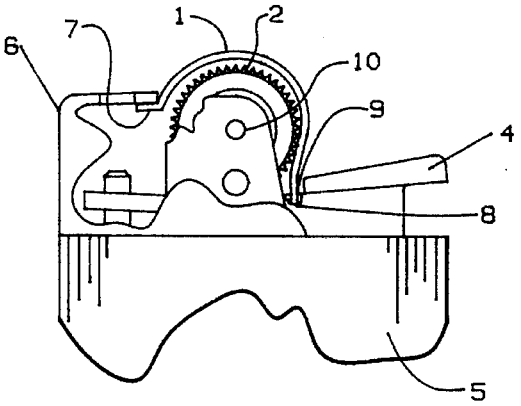
FIG. 7 is a side view of FIG. 5.

FIGS. 1, 2, 5, and 7 are a view of shield 1 in the engaged position incorporated into cigarette lighter 5. FIG. 2 illustrates shield 1 and cigarette lighter 5 by revolving the lighter 5 90° clockwise, showing the width of the shield 1 guarding the rotary sparker 3, as shown in FIG. 5. FIGS. 5, 6, 7 and 8 are views showing the shield 1 more clearly. FIG. 5 shows shield 1 in the full upward position. Shield 1 is held in that position by mechanical linkage and is attached to gas release lever 4. The compressible spring 13 holds the gas release lever 4 in the upward position and allows it to move downward when the lighter is ignited. FIG. 3 illustrates the configuration of shield 1 before being installed into lighter 5. Installation is accomplished by inserting the notched post 9 on the extreme end of sparker shield 1 which in turn is inserted into cavity 8 as shown in FIG. 7. FIG. 4 shows shield 1 in its unassembled free state.

FIG. 7 shows sparker shield 1 in the engaged position which is accomplished by placing flame wind breaker 6 into position on lighter 5 and over retaining ear 7. Sparker shield 1 is positioned over recessed sparker wheel 3 which is smaller in diameter than knurled edges 2 as shown in FIG. 3. Formed ear 7 is held under flame wind breaker 6 and notched post 9 is pressed into cavity 8. When in proper position, children will be deterred from removing sparker shield 1 and igniting the lighter.

Figure 8:
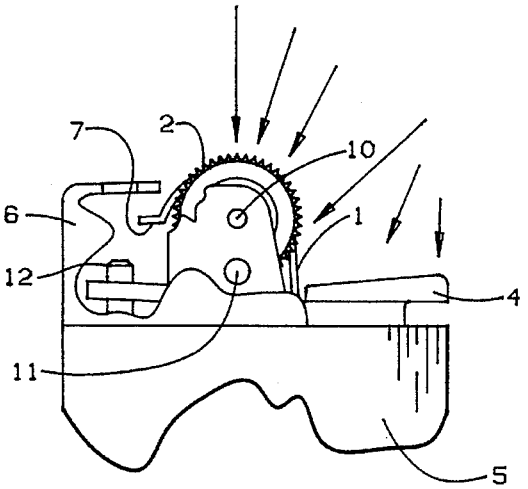
FIG. 8 is a side view of FIG. 6.
Figure 9:
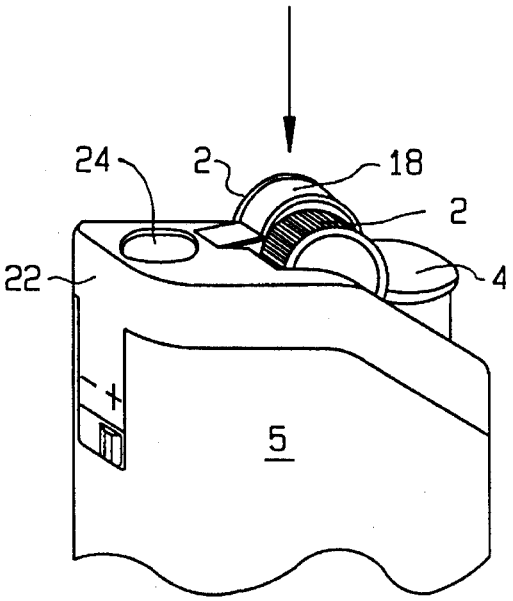
FIG. 9 is a perspective view of a modification with part broken away.

FIGS. 6 and 8 clearly illustrate the sparker shield 1 depressed, arrows show direction of thumb pressure being asserted to sparker shield 1 thereby rotating the rotary sparker 3 against flint 32, which cooperates with the wheel to produce ignition sparks. The thumb then moves in a direction toward and depresses gas release lever 4. When the thickness of sparker shield 1 is at the correct dimension, thin enough to expose the knurling 2 of the sparker wheel, this will create enough friction between the operator's thumb and knurled edges 2 on sparker wheel 3 when moved in the direction of gas lever 4 very quickly and vigorously, to create enough spark to ignite the gas or lighter fluid. The gas or lighter fluid is released from the fuel supply of the lighter through a valve 12 or closure 12 for the fuel supply.

Also, when the thickness of the sparker shield 1 is correct, this will deter children from igniting the lighter.

Therefore it is seen that objects of the invention have been carried out. A child with a small hand and limited physical strength will find it difficult to apply enough force to depress shield 1 in order to operate the lighter. The notched post 9 can be of any shape, facilitating assembly.

Another embodiment of the invention is shown in FIGS. 9, 10, 11, and 12.

The depressible shield 18, spring member 20, and the flame wind breaker 22, are all formed from the same piece of metal.

Figure 10:
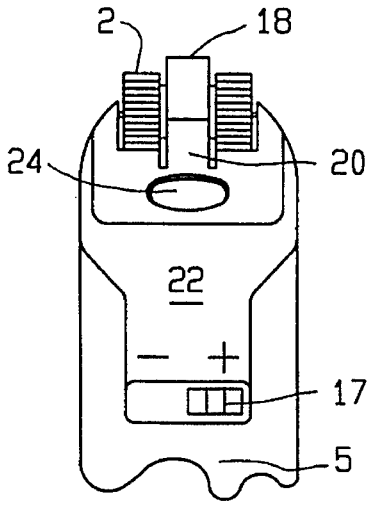
FIG. 10 is an end elevational view of FIG. 9.
Figure 11:
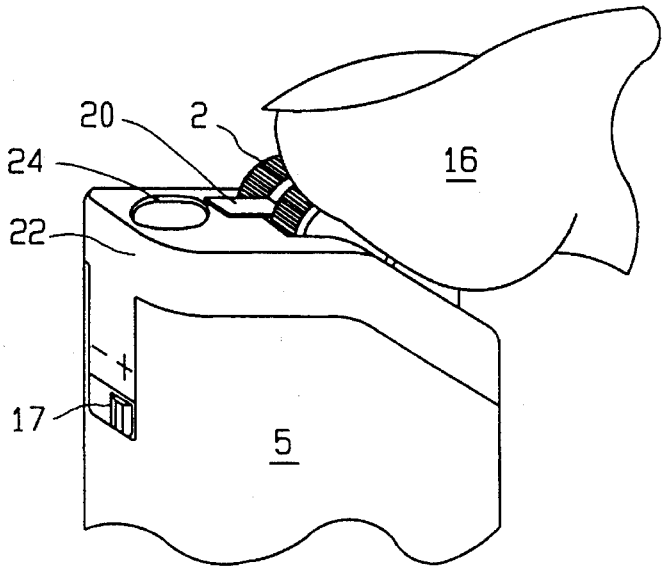
FIG. 11 is a perspective view similar to FIG. 9 showing the lighter in use.
Figure 12:
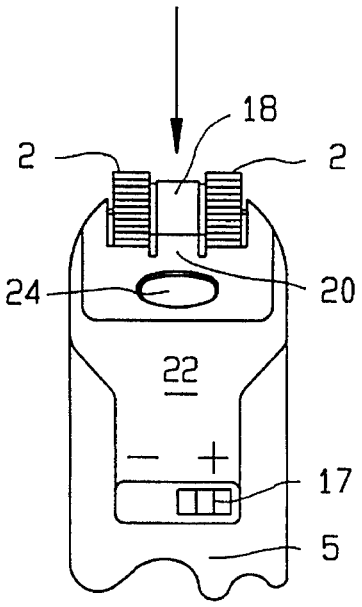
FIG. 12 is an end elevational view of FIG. 11 but omitting the operator's thumb.
Figure 13:
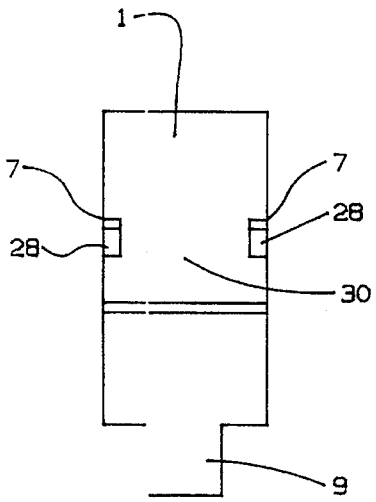
FIG. 13 is an elevational view of a modification of the shield.
Figure 14:
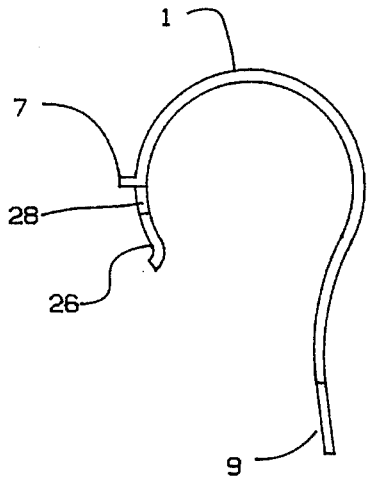
FIG. 14 is a side elevational view of FIG. 13.
Figure 15:
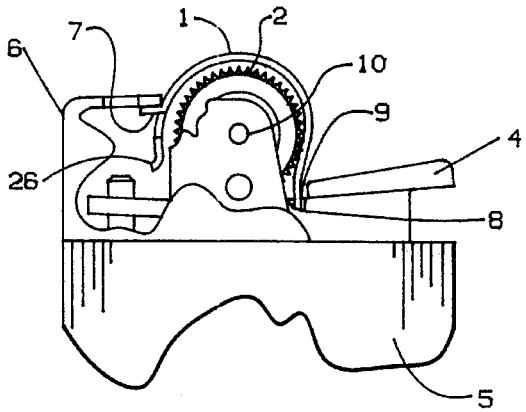
FIG. 15 is an elevational view of the lighter cut away to show the shield in inoperative position.
Figure 16:
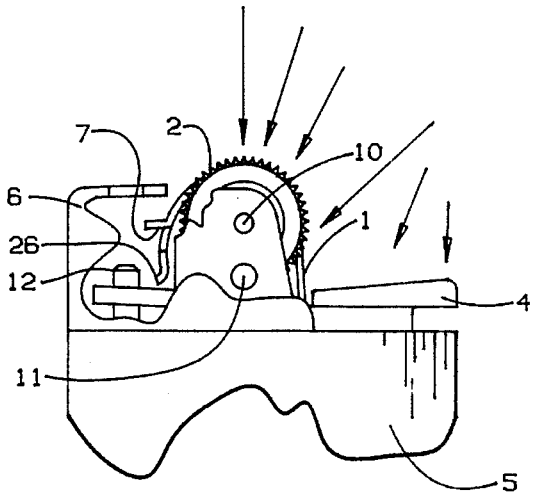
FIG. 16 is a view similar to FIG. 15 but showing the device in operative position.

After the wind breaker 22, and depressible shield 18, are formed to the proper shape they are then hardened to spring temper. By governing the thickness of the steel used for the wind breaker 22, this will determine the amount of downward thumb pressure needed to be applied to ignite the lighter. Further, the shield can be made more flexible by providing at least one slit 19 on shield 1 as shown in FIGS. 10 and 12.

FIGS. 13, 14, 15, and 16 show another embodiment of the invention. When a child tries to ignite the lighter by depressing gas relief lever 4, while not depressing sparker wheel shield 1, and by rotating the sparker wheel 2, with his or her thumb, spark guard 26, remains in position to block the sparks, thus keeping the lighter from igniting.

When the sparker wheel shield 1, and gas release lever 4, are depressed properly, the spark guard 26, is moved downward and out of position. The sparker wheel 2, is rotated and the sparks are allowed to travel through the flash hole 30. The lighter is then allowed to ignite.

In the event that more resistance is needed in order to prevent operation, the spring 13 for the gas lever 4 can be made stronger.

I claim:

1. A lighter comprising:

a lighter body containing a fuel reservoir with a valve for releasing fuel therefrom;

spark producing element having a surface adapted for contact by a user and rotatable by a user to produce sparks directed toward said valve, said element mounted on the body with at least a portion of said contact surface exposed for manipulation and rotation by the user;

a valve actuator depressible to actuate said valve and release said fuel; and a shield member mounted on the lighter and extending around a portion of said spark producing element, wherein said shield member is disposed outward from said contact surface in a position which inhibits manipulation of the spark producing element by a user and is depressible to a position permitting manipulation of said spark producing element by contact with said contact surface thereby increasing the difficulty of producing sparks.

2. The lighter as set forth in claim 1 wherein the shield member, at a first end, is inserted into a cavity defined by the valve actuator and secured to the lighter thereby.

3. The lighter as set forth in claim 1 wherein a pressure necessary to depress the shield is proportional to the thickness of the shield.

4. The lighter as set forth in claim 1 wherein the shield is depressible by digital pressure.

5. The lighter as set forth in claim 4 wherein the digital pressure required to depress the shield and to operate the spark producing element is sufficient to increase the level of difficulty of operation of the lighter.

6. The lighter as set forth in claim 1, wherein said spark producing element comprises a sparker wheel adapted to strike a flint and wherein said sparker wheel is secured to a knurled edge having a diameter greater than the sparker wheel, said knurled edge comprising said contact surface.

7. The lighter as set forth in claim 1, wherein said lighter includes a windbreaker mounted on the body around the valve and the shield member is coupled at one end to the windbreaker and secured to the lighter thereby.

8. A lighter comprising:

a lighter body containing a fuel supply with a valve for releasing fuel therefrom;

spark producing element having a surface adapted for contact by a user and manipulatable by a user to produce sparks, said element mounted to the body with at least a portion of said contact surface exposed for manipulation and rotation by the user;

a windbreaker disposed on the lighter body;

a valve actuator depressible to actuate said valve and release said fuel; and a shield member mounted to the windbreaker and extending around a portion of said spark producing element, wherein said shield member is disposed outward from said contact surface and is depressible to a position permitting manipulation of said spark producing element by contact with said contact surface.

9. The lighter as set forth in claim 8, wherein the shield is formed integrally with the windbreaker.

10. The lighter as set forth in claim 9, wherein the shield and windbreaker further define slits therebetween on either side of the shield to increase the flexibility of said shield.

11. The lighter as set, forth in claim 8, wherein the shield is depressible by digital pressure.

12. The lighter as set forth in claim 11 wherein the digital pressure required to depress the shield and to operate the spark producing element is sufficient to increase the level of difficulty of operation of the lighter.

13. A lighter comprising:

a lighter body containing a fuel supply with a valve for releasing fuel therefrom;

spark producing element having a surface adapted for contact by a user and rotatable by a user to produce sparks directed toward said valve, said element mounted on the body with at least a portion said contact surface exposed for manipulation and rotation by the user;

a valve actuator depressible to actuate said valve and release said fuel; and a shield member mounted on the lighter and extending around a portion of said spark producing element, wherein said shield member is disposed outward from said contact surface and is depressible to a position permitting manipulation of the contact surface of said spark producing element, and wherein the shield member further comprises a spark guard portion normally interposed between the valve and the spark producing element to prevent sparks from reaching the valve unless the shield is depressed.

14. The lighter as set forth in claim 13 wherein the shield member further defines a flash aperture positioned on said member such that when the shield member is depressed, the flash aperture is moved to a position adjacent to the valve allowing sparks to pass therethrough to reach the valve.

15. The lighter as set forth in claim 13 wherein the shield member, at a first end, is inserted into a cavity defined by the valve actuator and secured to the lighter thereby.

16. The lighter as set forth in claim 13 wherein the shield member is depressible by digital pressure and the digital pressure required to depress the shield member and to operate the spark producing element is sufficient to increase the level of difficulty of operation of the lighter.

17. A lighter comprising:

a lighter body containing a fuel reservoir with a valve for releasing fuel therefrom;

spark producing element having a surface adapted for contact by a user and rotatable by a user to produce sparks directed toward said valve, said element mounted on the body with at least a portion of said contact surface exposed for manipulation and rotation by the user;

a valve actuator depressible to actuate said valve and release said fuel; and a shield member mounted on the lighter and extending around a portion of said spark producing element, wherein said shield member is normally disposed outward from said contact surface in a first position inhibiting manipulation of the spark producing element and is depressible towards the contact surface to a second position permitting manipulation of said spark producing element by contact with the contact surface thereby increasing the difficulty of producing sparks.

18. The lighter as set forth in claim 17 wherein said spark producing element comprises a sparker wheel adapted to strike a flint and wherein said sparker wheel is secured to a knurled edge having a diameter greater than the sparker wheel, said knurled edge comprising said contact surface.

19. The lighter as set forth in claim 18, wherein said shield member comprises a strip of resilient material secured to the lighter and extending around the spark producing element outward from the knurled edge when in the first position and resiliently returning to the first position after being depressed.

20. The lighter as set forth in claim 18, wherein said spark producing element comprises two said knurled edges, with the sparker wheel having a width disposed therebetween and spacing apart said knurled edges by said width.

21. The lighter as set forth in claim 20, wherein:

said shield member comprises a strip of resilient material secured to the lighter, said resilient strip having a width such that it may be positioned between said knurled edges; and said strip in the first position is disposed outward from the knurled edges and in the second position is disposed in part between the knurled edges and resiliently returns to the first position.

22. The lighter as set forth in claim 21 wherein digital pressure required to be exerted by the user to depress the resilient strip to the second position and to operate the spark producing element is sufficient to increase the level of difficulty of operation of the lighter.

23. A lighter comprising:

a lighter body containing a fuel reservoir with a valve for releasing fuel therefrom;

spark producing element comprising a sparker wheel adapted to strike a flint, said sparker wheel secured between two knurled edges having a diameter greater than the sparker wheel for contact and rotation by a user, wherein said spark producing element is rotatable by a user to produce sparks directed toward said valve and is mounted on the lighter body with at least a portion of said knurled edges exposed for manipulation and rotation by the user;

a valve actuator depressible to actuate said valve and release said fuel; and a strip of resilient material mounted on the lighter and extending around a portion of said spark producing element, wherein said resilient strip is normally disposed outward from said knurled edges in a first position inhibiting manipulation of the spark producing element and is depressible towards the knurled edges and sparker wheel to a second position, in part between the knurled edges, permitting manipulation of said spark producing element by user contact with the knurled edges thereby increasing the difficulty of producing sparks.

24. A lighter comprising:

a lighter body containing a fuel reservoir with a valve for releasing fuel therefrom;

spark producing element having a surface adapted for contact by a user and rotatable by a user to produce sparks directed toward said valve, said element mounted on the body with at least a portion of said contact surface exposed for manipulation and rotation by the user;

a valve actuator depressible to actuate said valve and release said fuel; and a shield member mounted on the lighter and extending around a portion of said spark producing element, wherein said shield member is disposed outward from said contact surface and is depressible to a position permitting manipulation of said spark producing element by contact with said contact surface;

wherein the shield member, at a first end, is inserted into a cavity defined by the valve actuator and secured to the lighter thereby, and wherein the first end of the shield member has a reduced thickness to form a notched post for insertion into said cavity in the valve actuator.

25. A lighter comprising:

a lighter body containing a fuel reservoir with a valve for releasing fuel therefrom;

spark producing element having a surface adapted for contact by a user and rotatable by a user to produce sparks directed toward said valve, said element mounted on the body with at least a portion of said contact surface exposed for manipulation and rotation by the user;

a valve actuator depressible to actuate said valve and release said fuel; and a shield member mounted on the lighter and extending around a portion of said spark producing element, wherein said shield member is disposed outward from said contact surface and is depressible to a position permitting manipulation of said spark producing element by contact with said contact surface;

wherein said lighter includes a windbreaker mounted on the body around the valve and the shield member is coupled at one end to the windbreaker and secured to the lighter thereby, and wherein the shield member is integrally formed with the windbreaker.

* * * * *